US005210989A

United States Patent [19]

Jakel

[11] Patent Number: 5,210,989

[45] Date of Patent: May 18, 1993

[54] LIGHTWEIGHT CEMENTITIOUS ROOFING, TAPERED AND RECESSED

[76] Inventor: Karl W. Jakel, 3924 Park Pl. #4, Montrose, Calif. 91120

[21] Appl. No.: 881,845

[22] Filed: May 12, 1992

[51] Int. Cl.[5] ..... E04D 1/22

[52] U.S. Cl. ..... 52/518; 52/553; 106/675

[58] Field of Search ..... 52/518-524, 52/553, 547, 548, 557, 560, 550; 106/93, 99

[56] References Cited

U.S. PATENT DOCUMENTS 329,513 11/1885 Underwood .
1,469,543 10/1923 Strachan et al. .
1,575,183 3/1926 Sinnett .
2,057,003 10/1936 Bugher .
2,293,744 8/1942 Miles et al. .
2,450,562 10/1948 Robinson et al. .
2,510,416 6/1950 Pretty .
2,624,298 1/1953 Farren ..... 52/553
2,796,637 6/1957 Miles .
3,783,570 1/1974 Storch .
3,841,885 10/1974 Jakel .
3,852,933 12/1974 Guzzo .
3,852,934 12/1974 Kirkhuff .
3,862,532 1/1978 Markos .
3,870,775 3/1975 Jakel .
4,240,840 12/1980 Downing et al. .
4,288,959 9/1981 Murdock .
4,514,947 5/1985 Grail .
4,637,860 1/1987 Harper et al. .
4,662,141 5/1987 Miko .
4,663,104 5/1987 Ito et al. .
4,666,648 5/1987 Brittain .
4,673,659 6/1987 Wood et al. .
4,741,131 5/1988 Parker .
4,778,529 10/1988 Barker et al. .
4,778,718 10/1988 Nicholls .
4,781,816 11/1988 Lee et al. .
4,787,190 11/1988 Papsdor ..... 52/553
4,856,236 8/1989 Parker .
4,899,514 2/1980 Brookhart, Jr. ..... 52/553
5,035,100 7/1991 Sachs .
5,047,086 9/1991 Hayakawa et al. .
5,059,371 10/1991 Saheki et al. .

*Primary Examiner*—Richard E. Chilcot, Jr.
*Assistant Examiner*—Winnie Yip
*Attorney, Agent, or Firm*—William W. Haefliger

[57] ABSTRACT

A roof shake having an elongated body with top and bottom surfaces that extend lengthwise of the body, the body having laterally spaced, elongated edges, and opposite ends. The body bottom surfaces have a taper angled to flatly engage the roof near an upper end of the shake, whereby the shake may be nailed to the roof in spaced relation to the end so that the taper engagement with the roof provides leverage resisting wind up-lift forces exerted on the shake near a lower end of the shake installed in spaced relation to the roof. The bottom surface has hollow shallow cavities to reduce weight. The length and width are such as to reduce number of shakes in installation.

11 Claims, 1 Drawing Sheet

LIGHTWEIGHT CEMENTITIOUS ROOFING, TAPERED AND RECESSED

BACKGROUND OF THE INVENTION

This invention relates generally to the provision of lightweight, fireproof roofing shakes, capable of withstanding installation and foot traffic, and without breakage, as well as wind up-lift forces, and more particularly concerns cementitious admixtures from which such roofing pieces are formed.

There is continuous need for improvements in lightweight cementitious shakes, and their installation, for example to prevent breakage during such installation, and thereafter, and to prevent up-lift due to wind.

Current lightweight concrete and fiber cement roof shakes and shingles are produced in flat sheets or continuous taper shapes. These shapes do not lay flat when installed and must flex when installed or walked upon. Necessary flexural strength is obtained using high density and therefore heavy materials in a thin ($\frac{1}{4}$ to $\frac{3}{8}$ inch thickness) section or low density lighter materials in a thicker (approximately $\frac{3}{4}$ inch thickness) section. The thin section materials suffer from low market appeal and the thicker section materials are not thick enough and suffer also from excessive breakage during application and underfoot traffic.

Existing alternate material shakes used to replace traditional wood shakes to provide fire safety, are made in 22 inch long by 12 inch maximum width shapes. These shakes are installed with a 10 inch exposure often over spaced sheathing boards which are on 11 inch centers making adjustment of the nailing point necessary. Additionally, from 120 to 150 shakes must be installed to cover 100 square feet of roof surface (1 roofing square).

It is the object of this invention to create a new shape which, when installed in a full double overlap shingled method, lays flat and can, therefore, be made very thick (up to $1\frac{1}{2}$ inches) using a very lightweight cementitious material (or other suitable material) which can be formed by standard extrusion or pressure/vibration tile, paver or block forming machines. Additionally, nail points are pre-marked in two, separate locations to provide for normal wind up-lift forces and for very high wind up-lift forces.

It is yet another object to produce shakes of minimum 23 inches long and minimum $12\frac{1}{2}$ inches wide size to allow for 11 inch exposure installation and 11 inch on center nailing points and 100 or less shakes per roofing square.

Prior roofing shakes or shingles and methods of production are disclosed, for example, in Jakel U.S. Pat. No. 3,841,885, Jakel U.S. Pat. No. 3,870,777, Kirkhuff U.S. Pat. No. 3,852,934 and Murdock U.S. Pat. No. 4,288,959, and Wood U.S. Pat. No. 4,673,659 describing problems encountered in lightweight extruded tile production.

SUMMARY OF THE INVENTION

It is a major object of the invention to provide improvements in the structure of, as well as the installation of, lightweight, roofing shakes or shingles made of cementitious or other materials.

Basically, and in accordance with one aspect of the invention, the improved roof shake has a) an elongated body with top and bottom surfaces that extend lengthwise of the body, the body having laterally spaced, elongated edges, and opposite ends, b) the body bottom surface having a taper angled to flatly engage the roof near an upper end of the shake, whereby the shake may be nailed to the roof in spaced relation to that end so that the taper engagement with the roof provides leverage resisting wind up-lift forces exerted on the shake near a lower end of the shake installed in upwardly spaced relation to the roof.

These and other objects and advantages of the invention, as well as the details of an illustrative embodiment, will be more fully understood from the following specification and drawings, in which:

DRAWING DESCRIPTION

DETAILED DESCRIPTION

Figure 1:
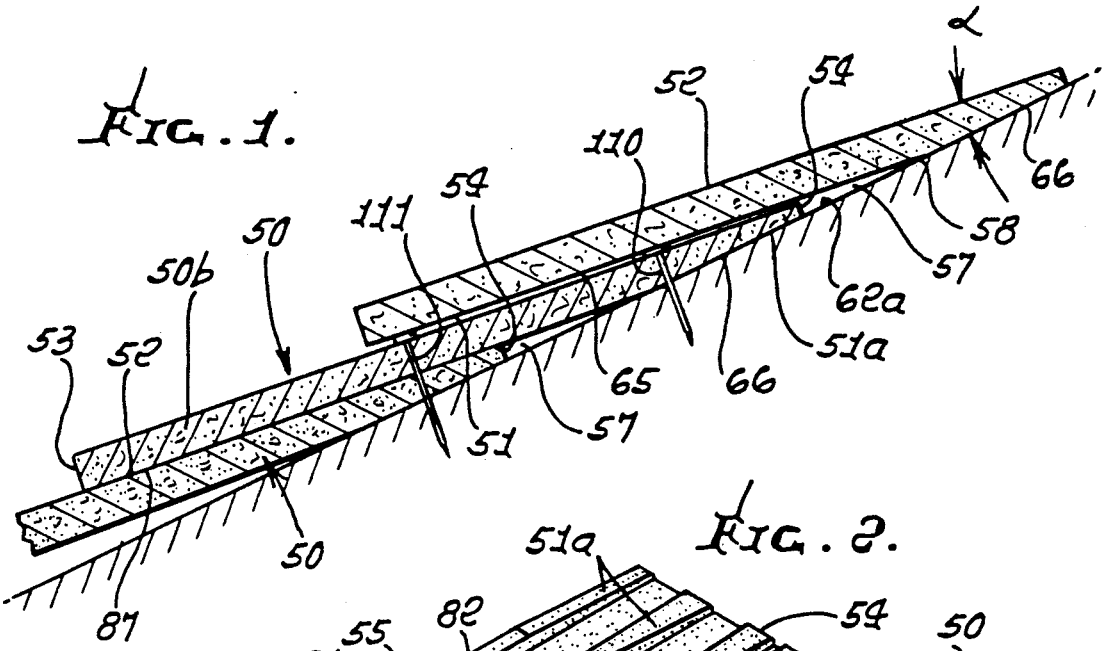
FIG. 1 is a section taken through installed shakes formed in accordance with the invention.
Figure 2:
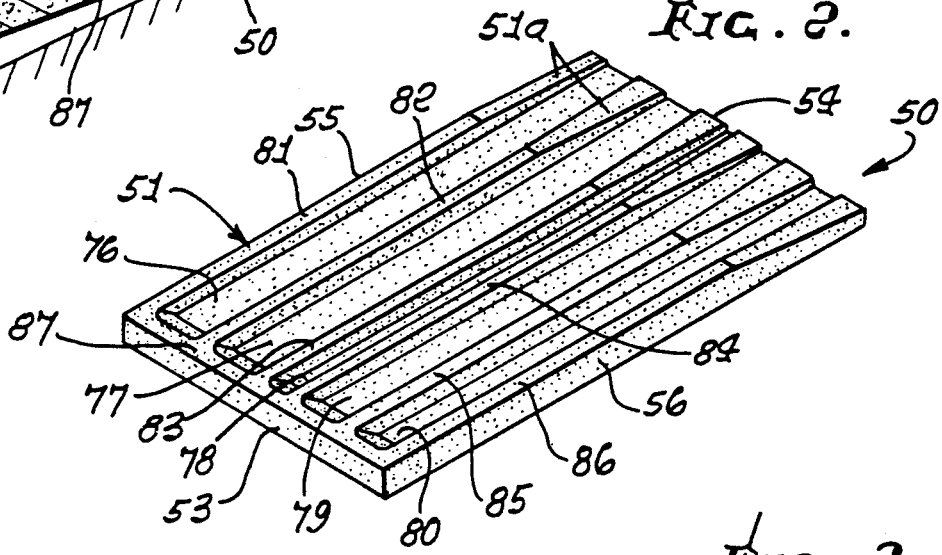
FIG. 2 shows a perspective view of the bottom of the FIG. 1 shake.
Figure 3:
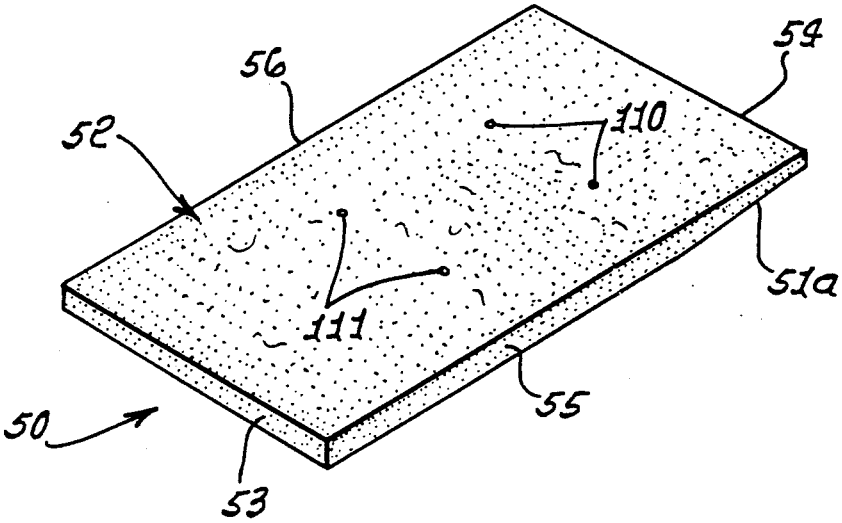
FIG. 3 is a view of the FIG. 2 shake in inverted position.

In FIGS. 1 and 2, the shake 50 has a bottom side 51, top side 52, forward or lower edge 53, rearward or upper edge 54, and right and left edges at 55 and 56. A beveled or tapered portion 51*a* of the shake bottom side 51 nearest edge 54, and extending between edges 55 and 56 is parallel to and flatly engages the roof. The front portion 50*b* of the shake is spaced from the roof 62*a* and directly and flatly supported on the rear extent of the top side 52 of the next lower shake 50 on the roof, as seen in FIG. 1. Each tile then has extensive bottom side planar support, at regions 65 and 66. Top surface 52 extends at angle $\alpha$ relative to 51*a* and 62*a*. The length of the tapered portion 51*a* from edge 54 is between 1/5 and $\frac{1}{3}$ the tile length.

Note that the only unsupported extents of the shakes are at recess portions 57 between taper edge 51*a* edge 58, and lower shake upper edge 54. Edges 54 may be squared off, as shown.

The shake bottom side seen in FIG. 2 is also provided with hollow shallow recesses or cavities 76–80 of elongated and selected generally rectangular shape, to reduce the mass of the shake, thereby reducing load on the roof. Elongated ribs 81–86 extend at opposite sides of the recesses and are load bearing as during walking of workmen on the roof. The bottoms of the ribs extend to the plane of shake bottom side 51. Both the recesses and the ribs intercept the tapered surface 51*a*, but are spaced from lower edge 53, as by a lateral ridge 87.

Pre-drilled or marked points for nailing the shakes are seen at 110. Wind up-lift forces tending to rotate the shakes clockwise about nail fulcrum points, at 110, are resisted by shake taper at 51*a* flatly engaging roofing 62*a*, between points 110 and edge 54.

Pre-drilled or marked points for nailing the shakes, as at 111, are located under overlapping extents of the next above shake. Wind up-lift forces tending to rotate the tiles clockwise are resisted by a very long fulcrum between points 111 and 54.

It is another object of the invention to provide a formulation of lightweight aggregates which have been graded and prepared in a very specific manner, and which, when mixed with Portland Cement in prescribed sequence, and specified mixer speeds, will produce a "dry" mix which can be easily extruded using existing extruding machines designed for standard concrete mixes, and which will extrude at very high speed on these machines without modification to the machine. The object is to make production of such lightweight shake products, as disclosed above, very efficient and therefore relatively inexpensive, compared to the slower "wet" processes being used currently.

It is yet another object to provide an aqueous, yet "dry" admixture that is extrudible to produce lightweight cementitious roofing shakes and shingles, that consist essentially of the components:

a) expanded perlite in particulate form b) an ingredient or ingredients selected from the group consisting of pumice and expanded shale, and expanded clay, that ingredient or those ingredients being in particulate form, and c) Portland Cement in particulate form.

Such an admixture also typically contains a small amount, by weight, of cellulose and/or polyester fiber. More specifically, the mix typically contains such components in relative weight amounts:

about 1 part of the above b) ingredient or ingredients about 1 part Portland Cement, about ½ part expanded perlite.

A further object is to provide an improved method of processing, including pre-screening of the aggregate, in order to produce a superior product. Thus, by grading standard sources of pumice, expanded shale or clay and expanded perlite into specific particle sizes and then re-combining them in a prescribed manner and sequence, a mix is created which can be bound together using common Portland Cement giving superior physical strength and maintaining a compacted weight only slightly heavier by volume than the aggregates themselves. The two grades, when recombined create an optimum range of particle sizes to be coated by the cement. Prior lightweight mixes using these aggregates (and other similar) did not remove the high quantities of fines (smaller than 50 mesh) in pumice, (pumicite) expanded shale or clay and perlite. These fines have enormous surface area and use up large quantities of cement to bind them, which results only in increased weight, thus defeating the reason for using lightweight aggregates. Additionally, such prior mixes using too many fines are difficult to extrude or press into shapes, since they resist flow and tend to "spring back" after the pressure is removed. The resulting product, if it can be formed at all, is generally very low in strength due to the low compaction resulting from improper aggregate particle size distribution.

Yet another object is to provide a formula of lightweight aggregates, fiber and Portland Cement, which, when graded, prepared and mixed as described produces a lightweight, fire and thermal resistive concrete which can be successfully and easily extruded into shapes for use in construction, principally, roofing tiles, shingle and shakes as described above. This mix can also be pressed into the same shapes and brick and block shapes using pressure and vibration as in a paver or block production machine. The resultant compressed product is homogeneous and uniform thus creating superior strength characteristics compared to present lightweight fiber cement mixes. This "concrete" is approximately half the weight of traditional concrete (specific weight is 0.85 to 1.0, or expressed in metric, 0.85 gr. per cc.) and is half as strong and absorbs the same amount of water.

The admixture formula to produce the described shingles and tiles is as follows, with parts listed by relative weight:

FORMULA: by weight 1 part Portland Cement
0.8 to 1.2 part Pumice (or expanded shale or clay)
0.3 to 0.4 part expanded Perlite
0.015 to 0.025 part treated cellulose fiber (optional)
0.005 to 0.015 part Polyester fiber (optional)
0.2 to 0.3 part water (portion 1)
0.4 to 0.6 part water (portion 2)

GRADES

Where: The Portland Cement is Type II Common or Type III High Early or Type C Plastic.

Where: The Pumice or expanded shale or clay as received is dried to less than 1% moisture content and then screened to create a material having the following sieve analysis expressed in % by weight retained on screen:

| | | |
|---|---|---|
| 4 | mesh | 0–5 |
| 8 | mesh | 10–20 |
| 16 | mesh | 20–30 |
| 30 | mesh | 30–50 |
| 50 | mesh | 5–15 |
| Pan | | 5 max. |

This material has a specific weight of 0.80–0.90 weighing 40 to 60 lbs/ft$^3$.

Where: The expanded Perlite is screened (before or after expansion) to create a material having the following sieve analysis expressed in % by weight retained on screen:

| | | |
|---|---|---|
| 8 | mesh | 0–7 |
| 16 | mesh | 30–40 |
| 30 | mesh | 25–35 |
| 50 | mesh | 15–25 |
| 80 | mesh | 0–6 |
| Pan | | 2 max. |

This material has a specific weight of 0.13–0.17 weighing 7 to 11 lbs/ft$^3$.

Where: The Polyester fiber is of 1.5 to 6.0 straight drawn and cut to 0.25 inch to 0.5 inch in length.

Where: The cellulose fiber is typically obtained from newsprint or kraft, opened fully by processing and moisture resistance treated.

PREPARATION

The Pumice, shale or clay preparation and handling prior to mixing must insure that the material does not segregate into concentrations of particle sizes within the grade. Anti-segregation methods of these aggregates must be employed in the transport and measuring systems.

The Pumice and/or shale must then be completely saturated with water (exposed to water until it stops increasing in weight) prior to mix start. Portion 1 of water is used for this purpose.

The Perlite must be handled (mixed for example) before and after expansion to insure that the particles do not segregate into concentrations of particle sizes within the grade. The Perlite may be either expanded "on demand" or handled insuring that the particles do not segregate prior to measuring and mixing.

MIXING

The sequence of the introduction of materials to the rotary mixer and the mixer rotor speeds and configuration are important:

1. The fiber, if used, is introduced into a rotating pan-high speed rotary mixer that has tip speeds in excess of 60 feet per second. Mix time continues until the fiber is completely opened.

2. Portland Cement is introduced into the fiber in the mixer and mixed at the same speeds until the fiber is fully dispersed into the cement.

3. The prepared Pumice or Shale is put into the mixer and rotor tip speeds reduced to 40 feet per second. The first portion of water has now been added. Mixing continues until homogeneity is reached.

4. Rotor tip speeds are further reduced to 10 to 12 feet per second prior to the introduction of Perlite. An alternate and preferred method is to transfer the mix from the rotating pan mixer to a folding paddle or screw type continuous mixer and to meter the Perlite into the mix.

5. The final mix with the second portion of water added may be at the low tip speed for very short time (10–15 seconds). Folding paddle or continuous screw (with back paddles) mixing is the preferred method to insure that the Perlite is not degraded by the mixing action.

Other common additives for concrete and lightweight cement or fiber cement products may be added at the appropriate places depending in the end use. These additives could include iron oxides for coloring, calcium chloride for curing acceleration, water repellant chemicals, etc. ... .

CURING

Product curing should begin immediately and in a controlled atmosphere. The humidity must be at least close to 80%. Temperatures can vary from 100° F. to as high as 170° (170 should not be exceeded) depending upon need for early strength in the particular product being produced

FORMING AND SHAPING

By changing water content and making slight adjustments to fiber type and amount, the mix can be formed and shaped in a variety of ways.

The principle method is extrusion where the forming pressure is approximately 200 lbs. per square inch and the typical extrusion method is as used to produce concrete roof shakes on a carrier pallet which creates the shape of the bottom of the shake and a roller and slipper shape the top surface, curing proceeding on the pallet or pallets, after which the shakes are removed. The lightweight mix does not have the strength of a typical concrete mix and therefore the shape of the shake and the thickness are modified in order that the resulting cured product can withstand foot traffic and pass the required "as installed"strength testing. The top surface of the shake which is shaped by the roller and slipper on the extrusion machine can be modified to produce any shape from a smooth European tile to a rough random shape of a cedar shake. The bottom surface is shaped by the pallet.

The second method of forming and shaping employs a standard paver or block forming machine as this mix easily and consistently is handled by such a machine without modification. Thus, products currently produced using standard heavy concrete mixes can, by using the present mix, be also produced in a lightweight version.

ADDITIONAL ADVANTAGES

The formula of light and very light aggregates with Portland Cement and cellulose fibers produces a strong, flexible, fire resistive and insulative concrete. This formula, when properly prepared and mixed is easily shaped by extrusion an vibrative pressure by unmodified industry standard machines used in making standard machines used in making standard heavy traditional concrete.

A combination of various grades of light and very light aggregates combined in described quantities as disclosed creates a balance and uniformity of particle sizes. This combination of particle sizes, when combined with Portland Cement, produces a uniformly graded and therefore strong concrete referred to as "Perlacem".

The method of preparing very light aggregate as disclosed is such that the particle distribution will remain constant and not vary due to ore changes or by storage segregation. This eliminates the common problem of water "take-up" variation which creates forming and shaping problems.

The formula of light and very light aggregates, graded and prepared as disclosed is such that maximum binding effect of the Portland Cement is achieved. Previous lightweight mixes using the same aggregates embodied too many of the naturally occurring fines (very small particles of the minus 50 mesh variety) and thus created an ineffective cement paste.

The present shake configuration is such that the effective span of the installed tile is greatly reduced by using a tapered tail section; in addition, the tile or shake shingle can be hollowed out and made much thicker than those presently manufactured, and it employs a sharp taper to achieve a flat layup on the roof.

It will be noted from the drawings that the shake has constant overall thickness from its lower end to its tapered end portion, and that as installed, the entire upper surfaces of the shakes are parallel.

While the shakes can be made using composition methods other than as disclosed herein, such disclosed composition and methods are of unusual advantage as respects production of a markedly superior shake.

I claim:

1. Roof shakes which are alike, there being, for each shake, a next-below shake, and each having:

a) an elongated cementitious body with top and bottom surfaces that extend lengthwise of the body, said body having laterally spaced, elongated edges, and opposite ends, b) the body bottom surface having a tapered end portion angled to flatly engage the roof near an upper end of the shake, whereby the shake may be nailed to the roof in spaced relation to said end so that said bottom surface tapered end portion engagement with the roof provides leverage resisting wind up-lift forces exerted on the shake near a lower end of the shake installed in spaced relation to the roof, c) said bottom surface tapered end portion extending from said upper end of the shake to a bottom surface region which is closer to said upper end of the shake than to the lower end of the shake, the shake being rectangular in outline, d) each shake having an untapered mid-portion between said opposite ends, the mid-portion of each shake overlying the tapered end portion of the next-below shake, e) and a fastener extending through the mid-portion of each shake and through the bottom surface tapered end portion of the next-below shake, f) the shake having constant overall thickness from said lower end to said tapered end portion, g) the entire upper surfaces of said shakes being parallel.

2. The shake of claim 1 wherein said body has at least one recess sunk upwardly into said bottom surface, said recess extending lengthwise of the body.

3. The shake of claim 2 wherein said recess intercepts said bottom surface taper.

4. The shake of claim 2 wherein the body has multiple recesses sunk upwardly into said bottom surface, inwardly from said elongated edges.

5. The shake of claim 4 wherein said recesses extend lengthwise of the shake body and intercept said bottom surface taper.

6. The shake of claim 5 wherein said recesses extend in generally parallel relation and intercept said upper end of the body, said recesses everywhere spaced from the lower end of the body.

7. The shakes of claim 1 wherein the bottom surface tapered end portion of each shake extends between 1/5 and ⅓ the length of each shake.

8. A roof shake having:

a) an elongated body with top and bottom surfaces that taper lengthwise of the body, said body having laterally spaced, elongated edges, b) the body bottom surface having a taper angled to flatly engage the roof near an upper end of the shake, whereby the shake may be nailed to the roof in spaced relation to said end so that said taper engagement with the roof provides leverage resisting wind up-lift forces exerted on the shake near a lower end of the shake installed in spaced relation to the roof, c) said shake having a composition that consists essentially of the components:

i expanded perlite in particulate form, ii an additional ingredient or ingredients selected from the group consisting of pumice and expanded shale, said ingredient or ingredients being in particulate form, and iii Portland cement in particulate form, said composition having been hydrated and cured.

9. The shake of claim 8 including a small amount by weight, relative to each of said perlite, additional ingredient or ingredients and Portland cement components, of at least one of the following:

cellulose fiber, polyester fiber.

10. The shake of claim 9 wherein said components are present in relative weight amounts:

0.8 to 1.2 part additional ingredient or ingredients, about 1 part Portland cement, 0.3 to 0.4 part expanded perlite.

11. Roof shakes which are alike, there being, for each shake, a next-below shake, and each having:

a) an elongated body with top and bottom surfaces that extend lengthwise of the body, said body having laterally spaced, elongated edges, and opposite ends, b) the body bottom surface having a tapered end portion angled to flatly engage the roof near an upper end of the shake, whereby the shake may be nailed to the roof in spaced relation to said end so that said bottom surface tapered end portion engagement with the roof provides leverage resisting wind up-lift forces exerted on the shake near a lower end of the shake installed in spaced relation to the roof, c) said bottom surface tapered end portion extending from said upper end of the shake to a bottom surface region which is closer to said upper end of the shake than to the lower end of the shake, the shake being rectangular in outline, d) each shake having an untapered mid-portion between said opposite ends, the mid-portion of each shake overlying the tapered end portion of the next-below shake, e) and a fastener extending through the mid-portion of each shake and through the bottom surface tapered end portion of the next-below shake, f) the shake having constant overall thickness from said lower end to said tapered end portion, g) the entire upper surfaces of said shakes being parallel.

* * * * *